United States Patent [19]

Koshelenko et al.

[11] 4,117,770

[45] Oct. 3, 1978

[54] AXIAL-PISTON HYDRAULIC MACHINE

[76] Inventors: Gennady Petrovich Koshelenko, ulitsa Sovetskoi Militssi, 10, kv. 31, Odessa; Rafail Moiseevich Pasynkov, ulitsa Cheljuskinskaya, 8, kv. 46; Mikhail Alexandrovich Sin, Sevastopolsky prospekt, 44, korpus 4, kv. 264, both of Moscow; Leonid Isaakovich Shemper, ulitsa Generala Petrova, 27, korpus 3, kv. 47, Odessa, all of U.S.S.R.

[21] Appl. No.: 686,802

[22] Filed: May 13, 1976

[51] Int. Cl.[2] ..... F01B 13/04

[52] U.S. Cl. ..... 92/57; 91/499; 92/71; 92/169

[58] Field of Search ..... 91/499; 92/12.2, 147, 92/57, 71, 169

[56] References Cited

U.S. PATENT DOCUMENTS

| | | | |
|---|---|---|---|
| 2,143,052 | 1/1939 | Chandler | 91/499 |
| 2,374,595 | 4/1945 | Franz | 92/71 |
| 2,949,100 | 8/1960 | Petersen | 92/57 |
| 2,990,784 | 7/1961 | Wahlmark | 91/499 |
| 3,153,987 | 10/1964 | Thoma | 92/57 |
| 3,237,569 | 3/1966 | Reaume | 91/499 |
| 3,304,884 | 2/1967 | Kouns | 92/57 |
| 3,371,616 | 3/1968 | Wahlmark | 91/499 |
| 3,821,922 | 7/1974 | Kouns | 91/499 |

FOREIGN PATENT DOCUMENTS

| | | | |
|---|---|---|---|
| 684,551 | 12/1952 | United Kingdom | 91/499 |

*Primary Examiner*—Martin P. Schwadron
*Assistant Examiner*—Abraham Hershkovits
*Attorney, Agent, or Firm*—Haseltine, Lake, & Waters

[57] ABSTRACT

An axial-piston hydraulic machine with a rotating cylinder block. The axial bores of said cylinder block accommodate reciprocating pistons. Said pistons restrict the working chambers some of which communicate through a passage with a high-pressure zone while the others communicate through a passage with a low-pressure zone. The surface of each working chamber at its minimum volume is spherical and merges smoothly with the passage.

2 Claims, 4 Drawing Figures

AXIAL-PISTON HYDRAULIC MACHINE

The present invention relates to volumetric hydraulic drives and more particularly it relates to axial-piston hydraulic machines.

Such hydraulic machines are used extensively in aircraft, transport, hoisting and road-construction machines, also in sea and river vessels, rolling mills, automatic production lines and other installations.

Most successfully the present invention will be used in axial piston pumps and hydraulic motors of earth-moving and transport machines, mainly in excavators and prime movers wth volumetric hydraulic transmissions. The experience gained in operation of axial-piston hydraulic machines proves that their basic parameters, such as fluid discharge pressure, shaft speed and durability depend to a large extent upon the design and strength characteristics of the cylinder block and on the shape of the working chambers.

In most cases, when abrasive wear of the sliding friction pairs is excluded due to adequate filtration of the working fluid and when the bearings have an adequate safety factor, the hydraulic machine is breakdown due to the breaking down of the cylinder block. Therefore, the requirement of cylinder block strength is the paramount problem in designing heavy-duty hydraulic machines. The higher the shaft speed and discharge pressure the higher the specific power of the hydraulic machine. The use of hydraulic drives with pumps ad hydraulic motors of higher specific capacity yields a considerable economic effect with respect to the prime manufacturing cost and operating expenses provided the increase in the specific power of the machine does not involve a reduction in its service life. Thus, provision of a new design of the cylinder block built for high operational characteristics and long life is an essential problem for all the manufacturers of axial-piston hydraulic machines.

The known designs of axial-piston hydraulic machines comprise a cylinder block with pistons reciprocating in its axial bores. The pistons restrict the working chambers. Some of the chambers communicate through passages with a high-pressure space whereas the other chambers communicate, also through passages, with a low-pressure space. Within one revolution of the cylinder block all the pistons pass alternately through two dead centres. As they pass through the dead centres, the fluid pressure changes instantaneously in each working chamber in succession. The higher the discharge pressure and the shaft speed, the higher the amplitude and frequency of pressure fluctuations in the working chambers. In all cases the difference between the pressure in the working chamber, i.e. inside the axial bore, and the pressure outside the cylinder block and in the adjacent working chamber whose piston is in the opposite phase to the position of the preceding piston, results in distortion of the cylinder block walls.

A disadvantage of the known designs of axial-piston hydraulic machines consists in that the design of the cylinder block leaves out of account the effect produced by the shape of the working chamber and the external configuration of the cylinder block upon its static and fatigue strength. These designs fail to ensure uniform strength in the cross sections of the block in the zone of the working chambers restricted by the end face of the piston located in the dead centre. The working chamber communicated by a passage with the high- or low-pressure space has different sections for the flow of fluid. Sharp changes in the cross sections of the bore create stress concentrators and reduce the fatigue strength of the cylinder block.

An axial-piston hydraulic machine already known in the art has a spherical face distributor and a cylinder block rotated by connecting rods whose side surfaces are capable of contacting the internal surface of the pistons thus transmitting torque from the shaft to the cylinder block.

The shaft is set in radial bearings and a thrust bearing. Secured to the shaft flange are the spherical heads of the connecting rods whose other ends are articulated to the pistons. Inasmuch as the axis of the cylinder block whose axial bores accommodate pistons is inclined to the shaft axis, the pistons during rotation of the shaft and cylinde block reciprocate relative to the cylinder block. Depending on the direction of movement of the pistons in the cylinder block bores the fluid either entes the working chambers or escapes from them. The working chambers whose pistons move in the same direction are connected by a passage with the high- or low-pressure space. In the course of one revolution of the cylinder block the fluid pressure in each working chamber changes twice.

The volumetric efficiency of the hydraulic machine is determined by leaks and interphase leaks of fluid from the working chambers.

The term "leaks" is used herein to determine the fluid flowing out of the delivery chamber and enters the space of the pump housing.

The term "interphase leaks" denotes the fluid which leaves the delivery chamber and flows through the distributor into the working chamber of another phase (discharge or suction).

The leaks from the working chambes enter the frame of the hydraulic machine wherefrom they are directed into a tank, the fluid pressure in the frame and outside the cylinder block being usually somewhat higher than atmospheric.

As the drive shaft rotates in the rolling contact bearings, the connecting rods articulated to it make rotary motions relative to the fixed frame of the hydraulic machine and reciprocating motions relative to the cylinder block. The cylinder block slides over the spherical surface of the distributor. The high- and low-pressure passages are in communication with the main lines which let the working fluid into and out of the hydraulic machine.

Thus, pressure in the working chambers changes periodically with a frequency proportional to the rotation speed of the cylinder block and the number of pistons, ranging from the delivery pressure to the suction or free discharge pressure. As a result, the walls of the cylinder block enclosing the working chamber are subjected to variable stresses which cause fatigue failures of the cylinder block walls. The effect of fatigue failures is further aggravated by various stress concentrators, such as a large difference of cylinder block sections in the working chamber zone, absence of fillets in the working chambers and in the passages communicating the working chambers with the passages of the distributor.

All the above factors lead to a comparatively rapid fatigue failure of the cylinder block in the working chamber zone.

An object of the present invention lies in raising the specific power of the hydraulic machine.

Another object of the present invention is to increase the service life of the hydraulic machine by improving the strength of the cylinder block.

Still another object of the present invention lies in increasing the hydromechanical efficiency of the machine by cutting down the hydraulic losses in its duct and lowering the level of noise produced by the working chambers at the moment of transition from the high-pressure to low-pressure space and back.

In accordance with these and other objects, the essence of the present invention lies in providing an axial-piston hydraulic machine whose rotating cylinder block accommodates reciprocating pistons enclosing the working chambers, some of which communicate through a passage with a high-pressure space while the others communicate, also through a passage, with a low-pressure space wherein, according to the invention, the surface of each working chamber at its minumum volume is spherical and smoothly merges into the passage.

The hydraulic machine built in this manner is noted for a longer service life owing to an improved strength of the cylinder block since the shape of the working chamber and the external configuration of the cylinder block in the working chamber zone meet the requirement of uniform strength of the cylinder block walls in all directions and because this design eliminates the stress concentrators which reduce the fatigue strength.

At sharp changes of fluid pressure in the working chamber of this shape the deformations and stresses in the working chamber walls are distributed evenly. When the fluid is compressed in the working chamber this creates a shock wave in it, said wave constituting a source of noise. The noise level depends on the position of the shock wave focus relative to the working chamber walls. The focus of the shock wave coincides roughly with the intersection of the axes of symmetry of the spherical surface of the working chamber. Such a shape of the working chamber increases considerably both the static and fatigue strength of the cylinder block and reduces the noise level.

It is expedient that the external surface of the cylinder block in the zone of the working chambers with a spherical surface should be concentric with said surface of the chambers.

As distinct from the known designs wherein the end portion of the block which is developed in the diametrical direction ensures an increase in the supporting distributing surface and is not in any way influenced by the shape of the working chamber, the design according to the invention due to the above-mentioned configuration ensures uniform strength of the cylinder block walls. Besides, this shape of the cylinder block increases rigidity and decreases distortions of the cylinder block walls around the working chamber. This is particularly important in order to reduce bending of the chamber bottom towards the distributing face whose surface is machined with a high degree of precision and whose surface irregularitites should be smaller than the thickness of the fluid film which is equal to a few microns or tens of microns.

It is recommended that the external surface of the cylinder block in the zone of the working chambers with a spherical surface should be provided with a reinforcing band whose external surface is concentric with said surface of the chambers.

Apart from strengthening said portion of the cylinder block, the band makes it possible to employ the widely used and known cylindrical structures for the cylinder block of the new design. By selecting the required interference fits and the materials of the band it is possible to make the built-up cylinder block stronger than the integral block made of a heterogeneous material; in many cases this solution offers technological advantages too.

Other objects and advantages of the invention will be more apparent from the following example of its realization and from the accompanying drawings in which.

Figure 1:
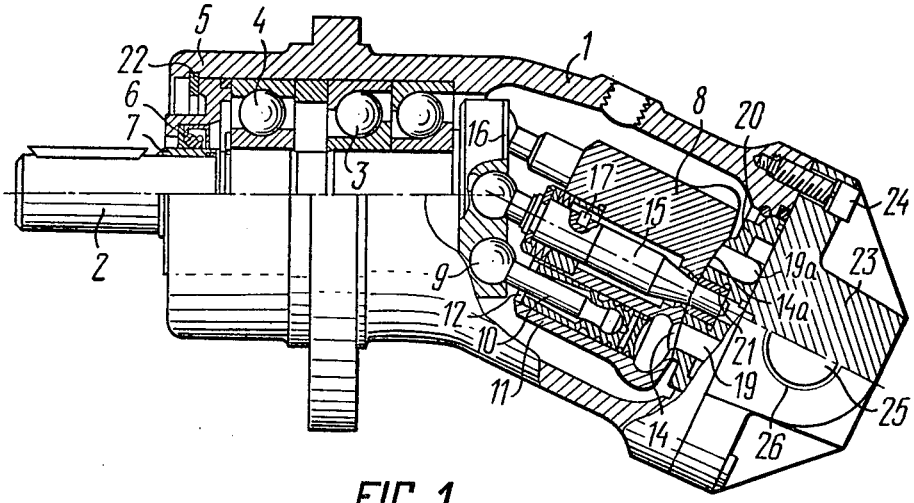
FIG. 1 is a schematic longitudinal section through the axial-piston hydraulic machine according to the invention.

The axial-piston hydraulic machine comprises a frame 1 (FIG. 1) which accommodates a shaft 2 installed in an angular bearing 3 and a radial bearing 4. The latter bears with its face against a cover 5 whose bore receives a cup seal 6. The seal 6 makes the inner space of the hydraulic machine pressuretight over the external cylindrical surface of the bushing 7 rotating with the shaft 2 and fitted tightly on the latter. The opposite end of the shaft 2 is made in the form of a flange with hemispherical bores on the face directed to the cylinder block 8. Secured in these bores are the heads 9 of the connecting rods 10 articulated to the pistons 11 which are installed with a provision for reciprocating in the axial bores 12 of the rotating cylinder block 8. The pistons 11 restrict the working chambers 13, some of which communicate through a passage 14 with the high-pressure space while the other communicate through the passage **14*a* with the low-pressure space. Fastened in the central hemispherical bore of the flange of the shaft 2 together with the connecting rod 10 is a journal 15 serving as a radial support of the cylinder block 8. The connecting rods 10 and the journal 15 are fastened to the flange of the shaft 2 by a plate 16. With the aid of bolts (not shown in the drawing) said plate presses the heads 9 of the connecting rods 10 against the shaft 2 and keeps them from being pulled out of the hemispherical bores by the loads directed towards the pistons 11. Owing to the dowel 17, the central journal 15 rotates in synchronism with the cylinder block 8**.

Figure 2:
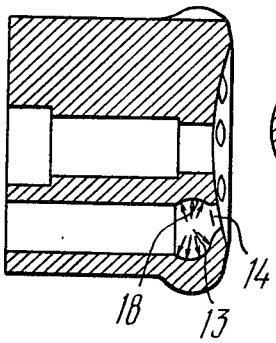
FIG. 2 is a longitudinal section through the cylinder block.

The surface 18 (FIG. 2) of each working chamber 13 at its minimum volume (i.e. the portion of the working chamber 13 which encloses the so-called entrapped volume of fluid when the piston 11 is in the dead centre) is spherical and merges smoothly into the passages 14 or **14*a* which communicate respectively with the ports 19 or 19*a* of the distributor 20**.

The spherical face surface of the distributor 20 forms a sliding friction pair with the mating spherical surface of the cylinder block 8. In addition to distributing the fluid, the distributor 20 serves as the second radial support of the cylinder block 8. The spherical head of the journal 15 rests on the hemispherical bore of the flange of the shaft 2 while its opposite end bears against a sliding-friction bearing in the form of a bushing 21 press-fitted into the central bore of the distributor 20. The shaft 2 with bearings 3 and 4, the cylinder block 8 with the pistons 11 and connecting rods 10 are accommodated in the frame 1.

A recess of said frame 1 receives a thrust ring 22 which transmits the axial load from the side of the bearings 3 and 4 to the frame 1.

The flat surface of the distributor 20 rests on the rear cover 23 which is secured by bolts 24 to the frame 1.

The cover 23 is provided with passages 25 communicating with a connection hole 26 to which a pipeline (not shown) is connected.

Figure 3:
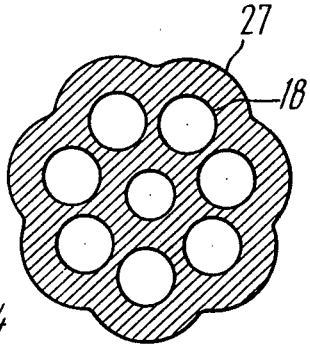
FIG. 3 is a cross section through the cylinder block.

The external surface 27 of the cylinder block 8 in the zone of the working chambers 13 with the spherical surface 18 is concentric with said surface 18 as shown in FIG. 3. This ensures uniform strength of the cylinder block walls. Such a shape of the cylinder block 8 improves rigidity and reduces distortions of the walls of the cylinder block 8 around the working chambers 13.

Figure 4:
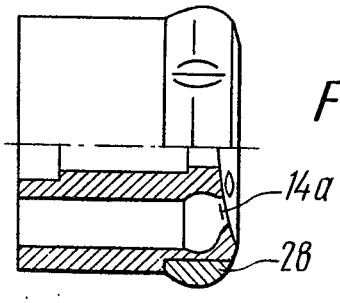
FIG. 4 shows the cylinder block with the band in the zone of spherical working chambers with a partial longitudinal cutout.

It is possible to provide a reinforcing band 28 on the external surface of the cylinder block 8 (FIG. 4) in the zone of the working chambers 13 with the spherical surface 18, the external surface of said band being concentric with said surface 18. Apart from strengthening the cylinder block 8, this will enable the cylinder block of the new design to be made from widely used and commonly known cylindrical structures.

The axial-piston hydraulic machine operates as follows.

During rotation of the shaft 2, the connecting rods 10 rotate together with it around the axis which is inclined to the axis of the shaft 2 at a certain angle. The pistons 11 articulated to the connecting rods 8 rotate together with the cylinder block and reciprocate relative to it in the axial bores 12. Within one revolution of the cylinder block 8 each piston 11 makes the working and idle strokes, passing through two dead centres. If the hydraulic machine functions at pumping duty, the pistons 11 during the working stroke move in the bores 12 towards the distributor 20, delivering the fluid from the working chambers 13 through the cylinder block passages 14 into the delivery part of the distributors 20.

From the space of the distributor 20 the fluid flows into the passages 25 of the rear cover 23 and into the connection hole 26 to which the pipeline is connected. Simultaneously, the other pistons 11 which perform an idle stroke suck in the fluid, moving away from the distributor 20 relative to the cylinder block 8. Like the delivery phase, the suction phase of each piston 11 takes place when the cylinder block 8 makes half a revolution. The spherical shape of the portion of the working chamber 13 improves the strength of the cylinder block 8 in the zone of the intrapped fluid volume. Inasmuch as the changes in the fluid pressure in each working chamber 13 are proportional in frequency to the rotation speed of the cylinder block 8 and the number of pistons 11, the long life of the machine will be ensured by a high fatigue strength of the cylinder block. The spherical shape of the portion of the chamber 13 weakens the stress concentrators, improves the hydraulic characteristics of the duct, at the same time reducing the level of air noise. The last feature becomes particularly important in the hydraulic machines installed near the workplace of the operator and in other cases when the acoustic characteristics of the hydraulic drive play an important role. The fluid leaking from the working chambers 13 through clearances in the sliding friction pairs along the pistons 11 and distributor 20 enters the frame 2 from where it is discharged through the hole and a pipe into a tank (not shown in the Figure).

If the hydraulic machine operates at the hydrualic motor duty, the fluid under pressure is delivered through the hole connection 26 of the rear cover 23 and through the passages 25 of the distributor 20 to the working chamber 13. Acted upon by the fluid pressure, the pistons 11 move out of the axial bores 12 of the cylinder block 8 and their progresssive motion is transformed during the working stroke into the rotary motion of the shaft 2.

We claim:

1. An axial-piston hydraulic machine comprising: a rotating cylinder block with axial bores; pistons reciprocating in said axial bores and enclosing working chambers in said bores; passages communicating some of the working chambers with a high-pressure space, other passages communicating the others of said chambers with a low-pressure space, said working chambers having minimum volume when said pistons are at their end positions, the surface of each of said working chamber in the end position of the respective piston being spherical and merging smoothly into a corresponding passage, said block having uniform wall thickness along the working chambers, the outside configuration of said block conforming to the inside shapes of the chambers, said block being of uniform strength construction, the external surface of said block having a corrugated form only in the zone of the working chambers where fluid compression occurs, the surface of said block being cylindrical in the zone of the piston bores; a reinforcing band attached to the external surface of said cylindrical block and located in the zone of said working chambers with a spherical surface, the external surface of said band being concentric with said surface of the chambers.

2. An axial-piston hydraulic machine comprising: a rotating cylinder block with axial bores; pistons reciprocating in said axial bores and enclosing working chambers in said bores; passage communicating some of the working chambers with a high-pressure space; other passages communicating the others of said chambers with a low-pressure space, said working chambers having minimum volume when said pistons are at their end positions, the surface of each of said working chamber in the end position of the respective piston being spherical and merging smoothly into a corresponding passage, said block having uniform wall thickness along the working chambers, the outside configuration of said block conforming to the inside shapes of the chambers, said block being of uniform strength construction, the external surface of said block having a corrugated form only in the zone of the working chambers where fluid compression occurs, the surface of said block being cylindrical in the zone of the piston bores, the external surface of said cylinder block in the zone of said spherical working chambers being concentric with said spherical surface of the chambers; a reinforcing band attached to the external surface of said cylindrical block and located in the zone of said working chambers with a spherical surface, the external surface of said band being concentric with said surface of the chambers, said band being located in the zone of piston movement and outside the zone of the entrapped volume where fluid compression may occur.

* * * * *